United States Patent [19]

Leasher et al.

[11] 4,006,324

[45] Feb. 1, 1977

[54] ELECTRICAL DISTRIBUTION PANEL LOCKOUT MEANS FOR SWITCH ACTUATORS

[75] Inventors: Arthur L. Leasher, Beaverton; Lawrence F. Sanborn, Midland, both of Mich.

[73] Assignee: The Dow Chemical Company, Midland, Mich.

[22] Filed: Oct. 2, 1975

[21] Appl. No.: 619,120

[52] U.S. Cl. ..... 200/42 T; 70/DIG. 30; 200/44

[51] Int. Cl.[2] ..... H01H 27/10

[58] Field of Search ..... 200/42 T, 42 R, 44, 200/318, 321, 322; 317/99, 112, 120; 70/164, 203, 230, 232, DIG. 30

[56] References Cited

UNITED STATES PATENTS 2,978,613 4/1961 Hein ..... 200/42 R 3,784,766 1/1974 Johnson ..... 200/42 T

*Primary Examiner*—Gerald P. Tolin

*Attorney, Agent, or Firm*—M. B. Lilly; Earl D. Ayers

[57] ABSTRACT

The invention is a positive lockout means for circuit breakers in an electrical distribution box wherein a central bar extends from top to bottom of the box between the arrays of circuit breakers. The bar has an array of bores extending into the bar from the top side of the distribution. Rod-like locking elements having a configuration which permits one end of the locking element to pass into a bore in a circuit breaker actuator while the other end is inserted in a bore in the bar to prevent movement of the actuator element so secured. Positive lockout is provided by a cover plate which is positively secured in position over the central bar.

8 Claims, 4 Drawing Figures

ELECTRICAL DISTRIBUTION PANEL LOCKOUT MEANS FOR SWITCH ACTUATORS

BACKGROUND OF THE INVENTION

This invention relates to electrical distribution boxes having vertical rows of horizontally disposed circuit breakers therein, and particularly to such boxes which have means for positively locking any circuit breaker in a pre-set position.

In many applications, particularly in business or industry it is desirable to have a particular electrical circuit locked either in a "off" or "on" position.

For example, it would be desirable to have building "exit" signs on a circuit which was locked in an "on" position.

Any circuit which is being worked on should be "locked out."

Numerous means have been provided for locking distribution box controlled circuits in an "on" or "off" position, but have been either expensive, not "fail-safe" or somewhat complicated to couple to the circuit breaker and distribution box.

OBJECTS OF THE INVENTION

A principal object of this invention is to provide an improved fail safe means for locking in a pre-set condition circuits passing through an electrical distribution box.

Another object of this invention is to provide a simple, fail safe and inexpensive means for locking electrical circuits in a predetermined operative position at an electrical distribution box.

STATEMENT OF INVENTION

In accordance with this invention there is provided positive circuit locking means for use with electrical distribution boxes wherein there are vertical rows of horizontally disposed circuit breakers each having a toggle type actuator element with a horizontal bore extending therethrough.

The circuit locking means is a bar fixedly secured to said distribution box face, and extending between said vertical rows of circuit breakers and having an array of bores extending inwardly from the top of said bar, rod-like elements each having a configuration such that one end extends into a bore in said bar and the other end extends into the bore in a circuit breaker actuator, and locking cover means fitting closely over said bar.

BRIEF DESCRIPTION OF THE DRAWING

The invention, as well as additional objects and advantages thereof, will best be understood when the following detailed description is read in connection with the accompanying drawing, in which.

DETAILED DESCRIPTION OF THE DRAWING

Figure 1:
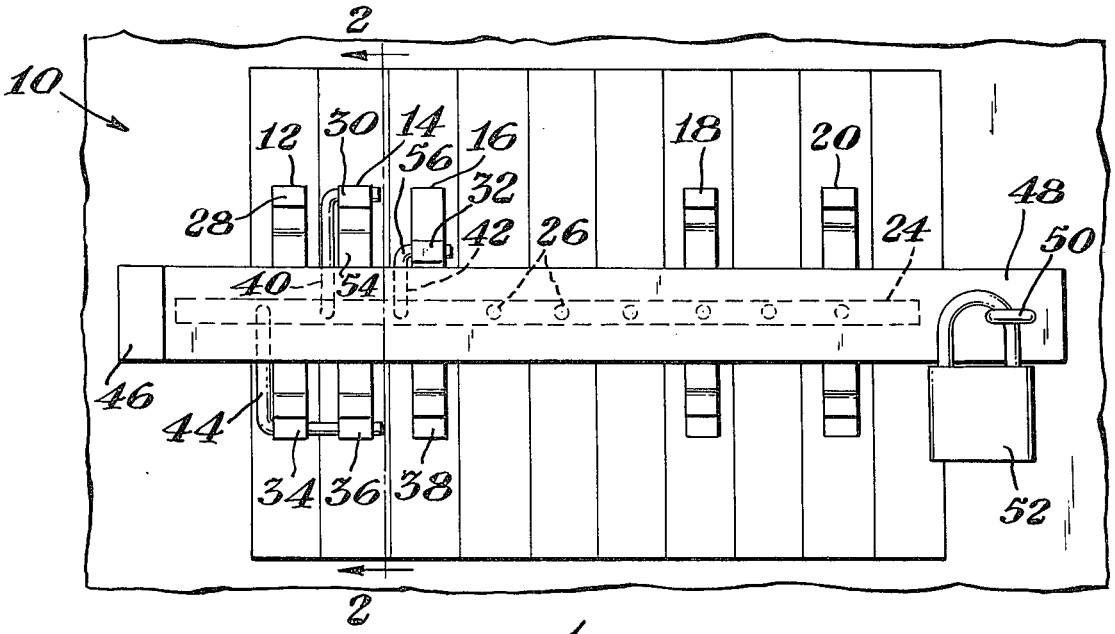
FIG. 1 is a plan view of that part of an electrical distribution box which contains side-by-side vertical rows of horizontally disposed circuit breakers.
Figure 2:
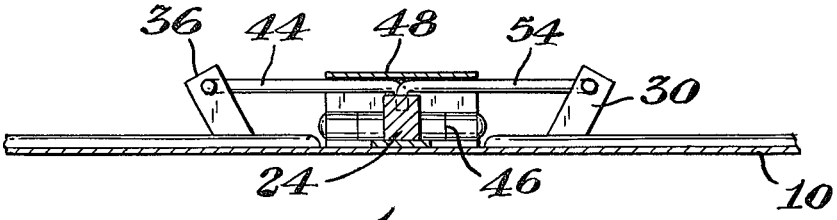
FIG. 2 is a sectional view taken along the line 2—2 of FIG. 1.
Figure 3:
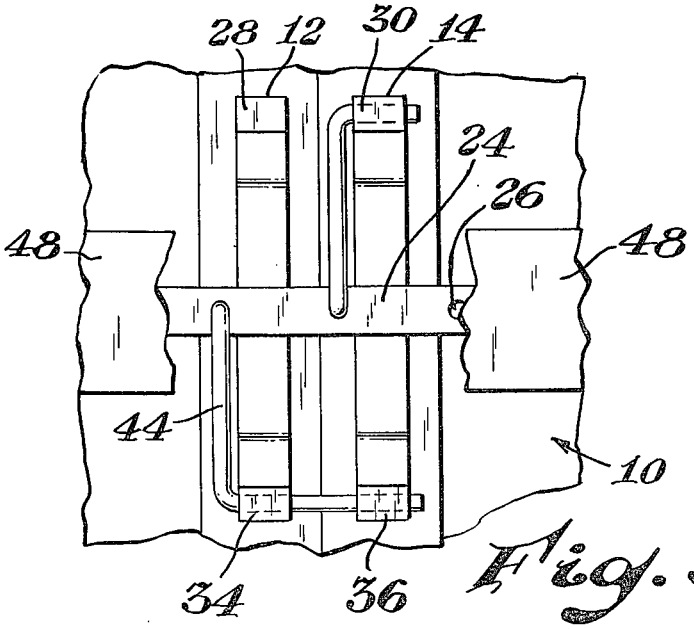
FIG. 3 is a fragmentary plan view in which the cover strip is broken away to better show the rigid wire-like element ends coupled to the bores in the bar.

Referring to the drawing there is shown the front plate 10 of an electrical distribution box which vertical arrays of horizontally disposed circuit breakers 12, 14, 16, 18, 20 disposed therein and extending approximately flush with said plate 10. A bar-like member 24 is disposed between each pair of vertical arrays of circuit breakers and is mechanically secured to the front plate 10.

The bar-like member 24 has an array of bores 26 spaced along its length and extending perpendicularly with respect to the plane of the plate 10.

Each circuit breaker has an actuator arm 28, 30, 32, 34, 36, 38, for example, which is a toggle element having a bore extending therethrough.

One of the locking elements 44, 54 or 56, for example, made of rigid material such as a bent rod, for example, has an end which fits through the bore in the actuator element of the circuit breaker and an end which fits into one of the bores 26 in the bar-like member 24.

Figure 4:
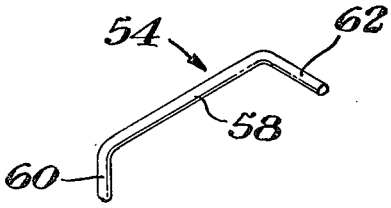
FIG. 4 is an isometric view of a rigid wire-like locking element.

FIG. 4 shows one locking element 54 which has an arm section 58 and end coupling sections 60, 62.

As shown, the end 60 extends vertically into a bore 26 while the end 62 extends horizontally through the bore in the actuator element 30.

The actuator element 44 has one longer end which extends through two actuator elements 34, 36 to lock those two circuit breakers in one position (the out position is shown in the drawing).

A locking plate 48, hinged at one end 46, extends over and covers the bar member 24 and may be locked in the covering position by means of a lock 52 extending through a lock 50 which is secured to the plate 10 and passes through a slot in the cover plate 48.

Operation

In operation, with the locking plate 48 hinged upwardly, locking elements of the appropriate type are coupled with one end through the chosen circuit breaker actuator elements and the other end extending into a bore 26 in the bar-like member 24. The locking plate is then lowered over the bar-like member 24 and is locked in position.

Under these circumstances, the circuit involving the locked circuit breaker is maintained in its fixed operative relationship and cannot be manually changed until the locking plate is raised and the locking element is removed from the actuator element of the breaker or from the bar-like member 24.

Each electrician will usually carry his own lock 52, so he can work on a locked out circuit with confidence that it will be safe to do so.

On occasion, a circuit may need to be locked in the "on" position, and a locking element with a shorter arm section may be used to accomplish this condition. An alarm circuit (having other fusing means) is an example of a circuit which may be locked in the "on" position.

Even if the front plate 10 is removed from the distribution box while a circuit or circuits are locked out, the breakers are pulled from the distribution box as the front plate is removed, assuring fail safe operation.

The locking arms are conveniently formed of thin, metal rod material and the end part which extends into the circuit breaker actuator is long enough to be prevented from removal thereform by attempting to pivot the locking element from the end which is coupled to the bar-like member 24.

Although the arm section and one end section of each locking element lies in a plane generally perpendicular to the plane of the arm and the other end section.

The hinged part 46 and the locking loop 50 are usually welded or riveted to the cover plate 10 to prevent easy removal.

What is claimed is:

1. In an electrical distribution box wherein there are a plurality of spaced apart vertical rows of horixontally disposed circuit breakers each of which has an end including an actuator element extending through the front cover plate of said box, each actuator element having a bore extending vertically therethrough the improvement comprising a bar-like member being secured to said front cover and disposed between a pair of vertical rows of circuit breakers, said bar-like member having an array of bores opening to the outwardly extending face of said bar-like member, a locking element having a rod-like arm part and first and second end parts, said first end part extending into the bore in an actuator element and said second end part extending into a bore in said bar-like member, and end secured bar cover plate means extending closely over said bar-like member.

2. An electrical distribution box in accordance with claim 2, wherein said bores in said bar-like member are disposed generally perpendicularly with respect to said front cover plate.

3. An electrical distribution box in accordance with claim 1, wherein said first end part of said locking element extends at least substantially through said bore in said actuator element.

4. An electrical distribution box in accordance with claim 1, wherein said bar cover plate means is secured at one end to said front cover plate by hinges.

5. An electrical distribution box in accordance with claim 4, wherein the other end of said bar cover plate means is locked to said front cover plate.

6. An electrical distribution box in accordance with claim 1, wherein said first and second end parts fit closely but slidably in said bore in said actuator element and in said bar-like member, respectively.

7. An electrical distribution box in accordance with claim 1, wherein said first end of said locking element is long enough to extend through the bores in two adjacent actuator elements.

8. An electrical distribution box in accordance with claim 5, wherein said bar cover plate means is locked by means of a removable lock.

* * * * *

UNITED STATES PATENT AND TRADEMARK OFFICE

CERTIFICATE OF CORRECTION

PATENT NO. : 4,006,324

DATED : February 1, 1977

INVENTOR(S) : Arthur L. Leasher et al.

It is certified that error appears in the above-identified patent and that said Letters Patent are hereby corrected as shown below:

In column 1, line 13, delete "a" and insert --an--.

In column 2, line 7, delete "24" and insert --22.

In column 2, line 68, delete "thereform" and insert --therefrom--.

In column 3, line 12, delete "horixontally" and insert --horizontally--.

In column 4, line 3, delete "claim 2" and insert --claim 1--.

Signed and Sealed this

Seventh Day of June 1977

[SEAL]

*Attest:*

RUTH C. MASON
*Attesting Officer*

C. MARSHALL DANN
*Commissioner of Patents and Trademarks*